US009502838B2

(12) United States Patent
Lin

(10) Patent No.: US 9,502,838 B2
(45) Date of Patent: Nov. 22, 2016

(54) ELECTRICAL CONNECTOR HAVING AN IMPROVED INSULATIVE BASE

(71) Applicant: FOXCONN INTERCONNECT TECHNOLOGY LIMITED, Grand Cayman (KY)

(72) Inventor: Min-Han Lin, New Taipei (TW)

(73) Assignee: FOXCONN INTERNATIONAL TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/948,129

(22) Filed: Nov. 20, 2015

(65) Prior Publication Data

US 2016/0149360 A1 May 26, 2016

(30) Foreign Application Priority Data

Nov. 21, 2014 (TW) ..... 103140346 A

(51) Int. Cl.

| | |
|---|---|
| ***H01R 13/514*** | (2006.01) |
| ***H01R 24/60*** | (2011.01) |
| ***H01R 13/506*** | (2006.01) |
| *H01R 107/00* | (2006.01) |

(52) U.S. Cl.

CPC ..... *H01R 24/60* (2013.01); *H01R 13/506* (2013.01); *H01R 2107/00* (2013.01)

(58) Field of Classification Search

CPC ..... H01R 13/514; H01R 23/7073; H01R 13/506; H01R 23/02; H01R 23/725

USPC ..... 439/660, 701

See application file for complete search history.

(56) References Cited

U.S. PATENT DOCUMENTS 7,748,999 B1 * 7/2010 Sun ..... H01R 12/716 439/607.36

8,011,969 B2 * 9/2011 Wang ..... H01R 13/65802 439/607.35

(Continued)

FOREIGN PATENT DOCUMENTS

CN 202585895 12/2012

*Primary Examiner* — Gary Paumen

(74) *Attorney, Agent, or Firm* — Wei Te Chung; Ming Chieh Chang

(57) ABSTRACT

An electrical connector includes an insulative housing defining a receiving room and a tongue portion in the receiving room, a first contact module defining a first embedded portion and a second contact module defining a second embedded portion both received in the insulative housing, and a shielding shell enclosing the insulative housing. The tongue portion defines a recess at a front end thereof and a first through hole, the recess engaging with a forehead of the first and second contact modules, the first through hole receiving the first and second contact modules while exposing the exposed upper surface of the first embedded portion and the exposed lower surface of the second embedded portion.

17 Claims, 10 Drawing Sheets

(56) References Cited

U.S. PATENT DOCUMENTS 8,038,480 B2 * 10/2011 Wei ..... H01R 13/502 439/607.01
8,500,495 B2 * 8/2013 Wang ..... H01R 13/502 439/488
9,039,457 B2 * 5/2015 Zhang ..... H01R 13/6275 439/357
2008/0299833 A1 * 12/2008 Abe ..... H01R 13/642 439/660
2010/0124851 A1 * 5/2010 Xiong ..... H01R 12/716 439/660
2010/0303421 A1 * 12/2010 He ..... G02B 6/3817 385/75
2011/0159747 A1 * 6/2011 Tung ..... H01R 13/506 439/660
2011/0250795 A1 * 10/2011 Su ..... H01R 4/26 439/660
2012/0077390 A1 * 3/2012 Tsai ..... H01R 13/6658 439/660
2013/0040499 A1 * 2/2013 Wang ..... H01R 13/6658 439/660
2013/0189880 A1 * 7/2013 Wang ..... H01R 13/7031 439/660
2015/0244111 A1 8/2015 Ju et al.
2015/0244118 A1 * 8/2015 Lin ..... H01R 24/60 439/357
2015/0270661 A1 9/2015 Kao et al.
2016/0079720 A1 * 3/2016 Zhong ..... H01R 24/66 439/660

* cited by examiner

ELECTRICAL CONNECTOR HAVING AN IMPROVED INSULATIVE BASE

BACKGROUND OF THE DISCLOSURE

1. Field of the Disclosure

The present disclosure relates generally to an electrical connector, and more particularly to an electrical connector that ensures a proper position of the conductive terminals thereof.

2. Description of Related Arts

China Patent No. CN202585895 discloses an electrical connector comprising an insulative housing, a contact module assembled to the insulative housing, and a metal shielding shell enclosing the insulative housing. The contact module includes a plurality of conductive terminals and an insulative base insert-molded with the conductive terminals.

U.S. Patent Application Publication No. 2015/0244118 discloses an electrical connector including an insulation body, an upper row of terminals insert molded with the insulative body, a lower terminal module mounted to the insulation body, a middle shielding sheet, and a metal casing. The insulation body includes a base and a tongue. The lower terminal module includes a lower row of terminals. Each of upper and lower row terminals has a contact portion exposed from upper and lower surfaces of the tongue, respectively. The middle shielding sheet is disposed in the tongue and located between the upper row and lower row of terminals. The metal casing encloses the insulation body to form a mating cavity for receiving a mating connector.

An improved electrical connector is desired.

SUMMARY OF THE DISCLOSURE

Accordingly, an object of the present disclosure is to provide an electrical connector ensuring the positive position of the conductive terminals.

To achieve the above object, an electrical connector comprises: an insulative housing defining a receiving room and a tongue portion in the receiving room; a first contact module being received in the insulative housing and comprising a first insulative base and a plurality of first conductive terminals insert molded in the first insulative base, each first conductive terminal including a first embedded portion having an exposed upper surface, a first connecting portion completely embedded in the first insulative base, and a first bent portion bent downwardly from the first connecting portion; a second contact module integrated under the first contact module, the second contact module being received in the insulative housing and comprising a second insulative base and a plurality of second conductive terminals insert molded in the second insulative base, each second conductive terminal including a second embedded portion having an exposed lower surface, a second connecting portion completely embedded in the second insulative base and a second bent portion bent downwardly from the second connecting portion; wherein the tongue portion defines a recess at a front end thereof and a first through hole, the recess engaging with a forehead of the first and second contact modules, the first through hole receiving the first and second contact modules while exposing the exposed upper surface of the first embedded portion and the exposed lower surface of the second embedded portion.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
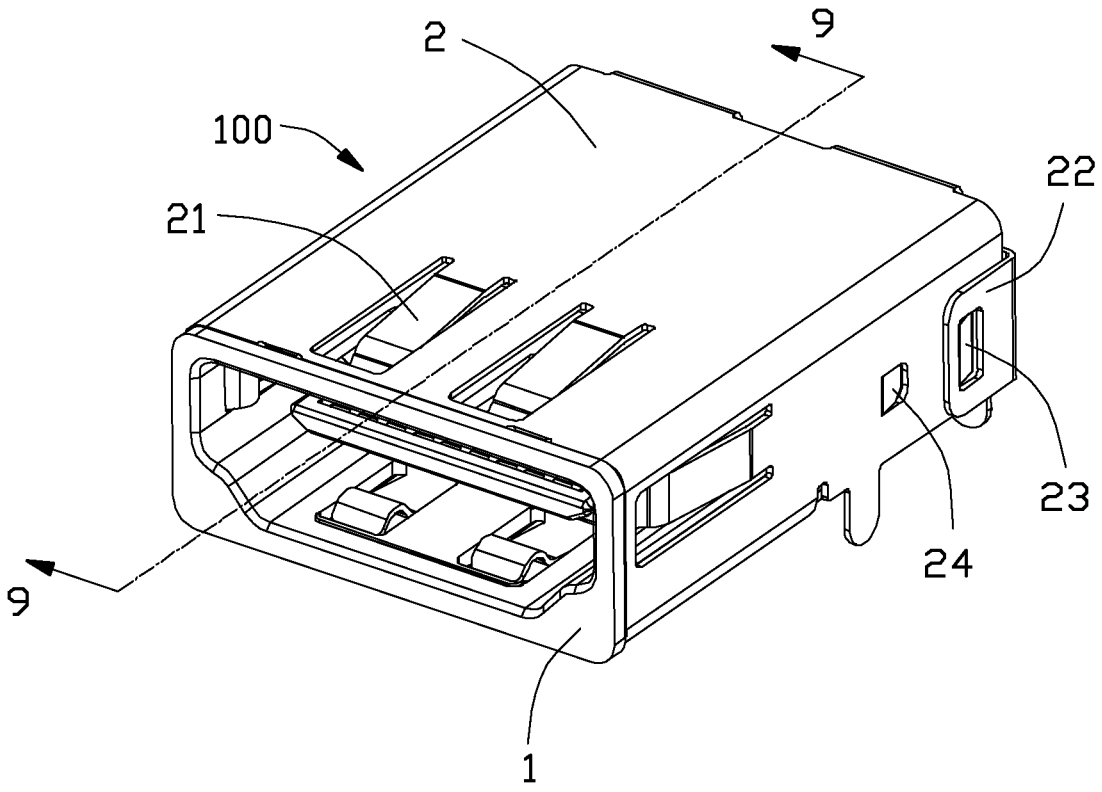
FIG. 1 is a perspective, assembled view of an electrical connector of the present disclosure.
Figure 2:
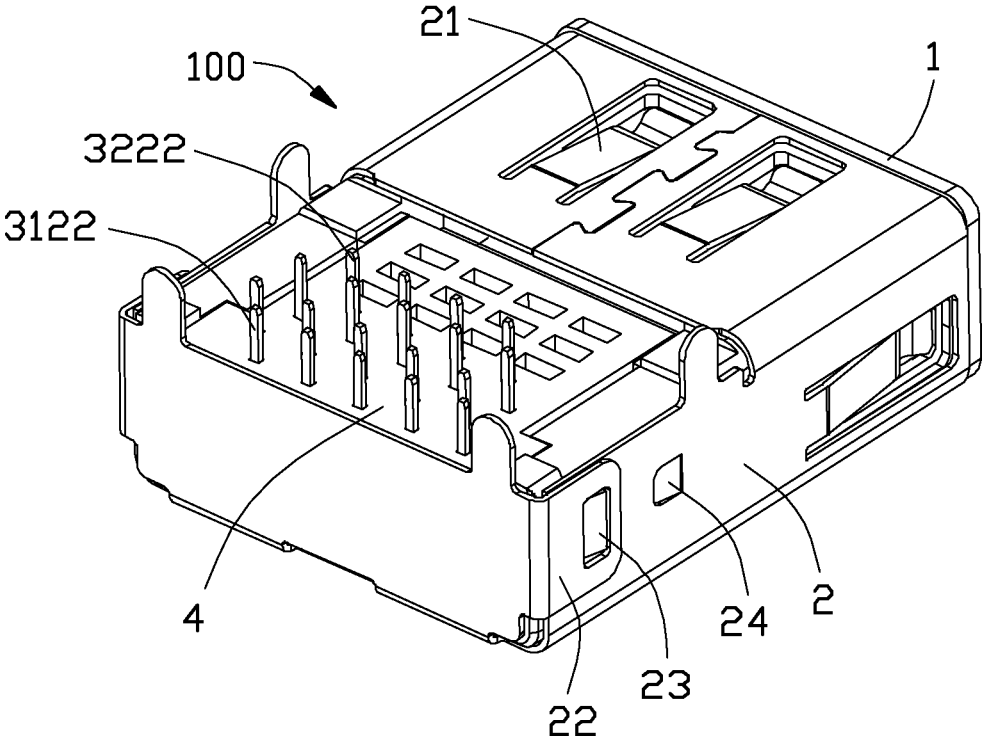
FIG. 2 is another perspective, assembled view similar to FIG. 1, taken from another aspect.

Reference will now be made in detail to the preferred embodiment of the present disclosure. Referring to FIGS. 1 to 4, an electrical connector 100 of the present disclosure, comprises: an insulative housing 1 defining a receiving room 15, a tongue portion 151 received in the receiving room 15, a pair of contact modules 3 received into the insulative housing 1, a fixing portion or spacer 4 stacked with the pair of the contact modules 3 and a shielding shell 2 enclosing the insulative housing 1.

Figure 3:
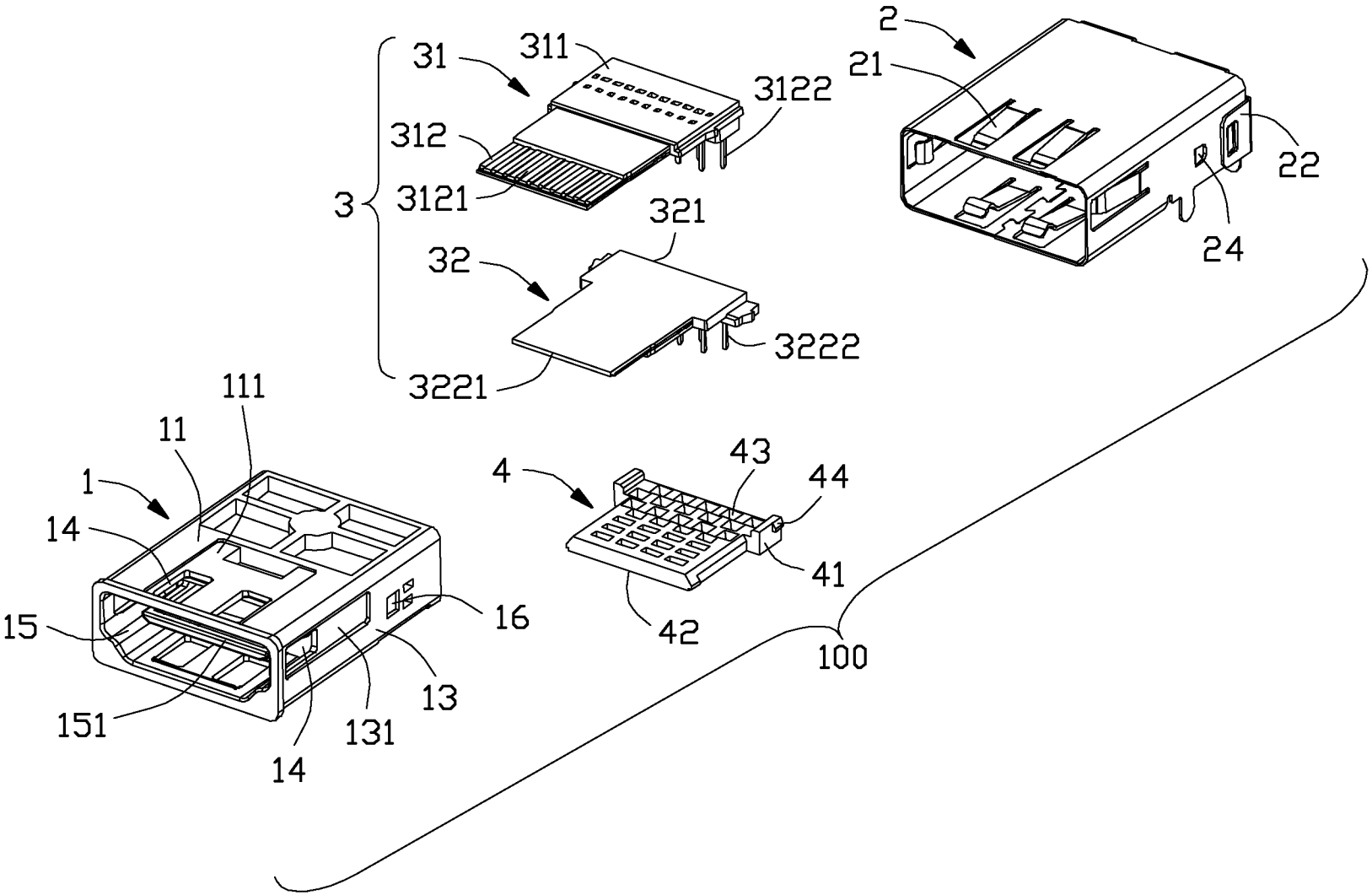
FIG. 3 is an exploded view of an electrical connector in FIG. 1.
Figure 4:
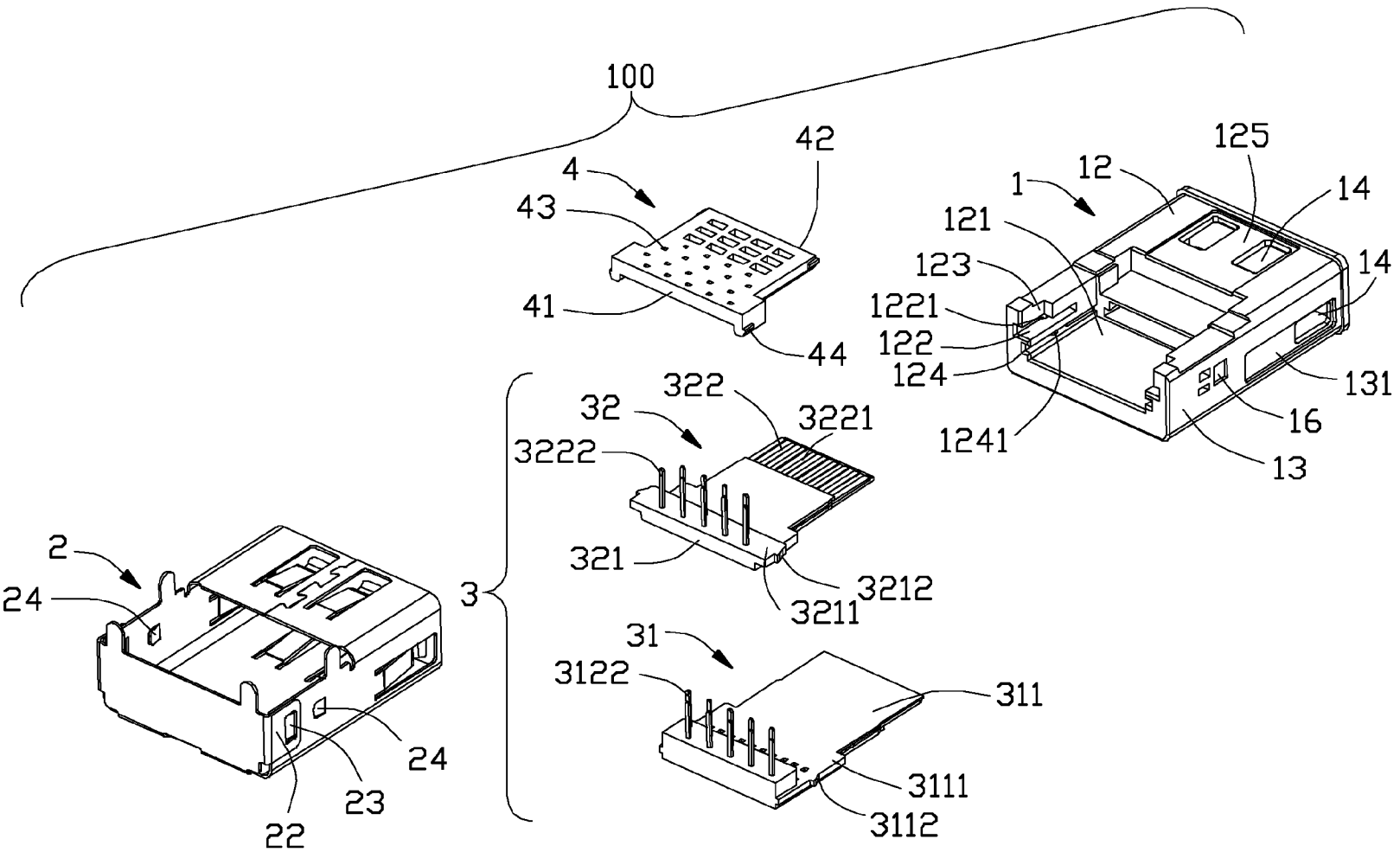
FIG. 4 is an exploded view of an electrical connector in FIG. 2.
Figure 5:
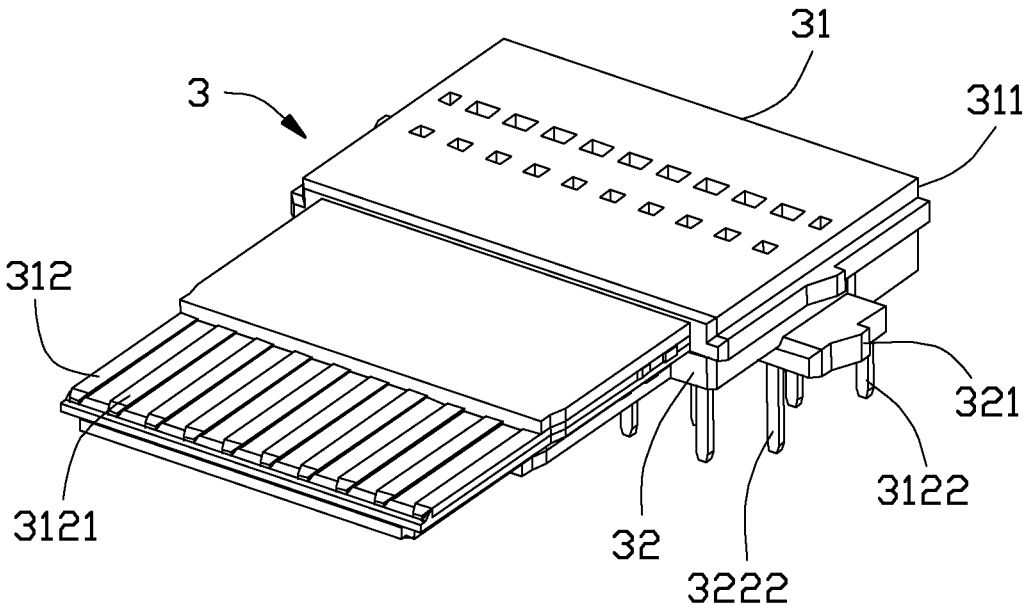
FIG. 5 is a perspective, assembled view of a contact module of the electrical connector.
Figure 6:
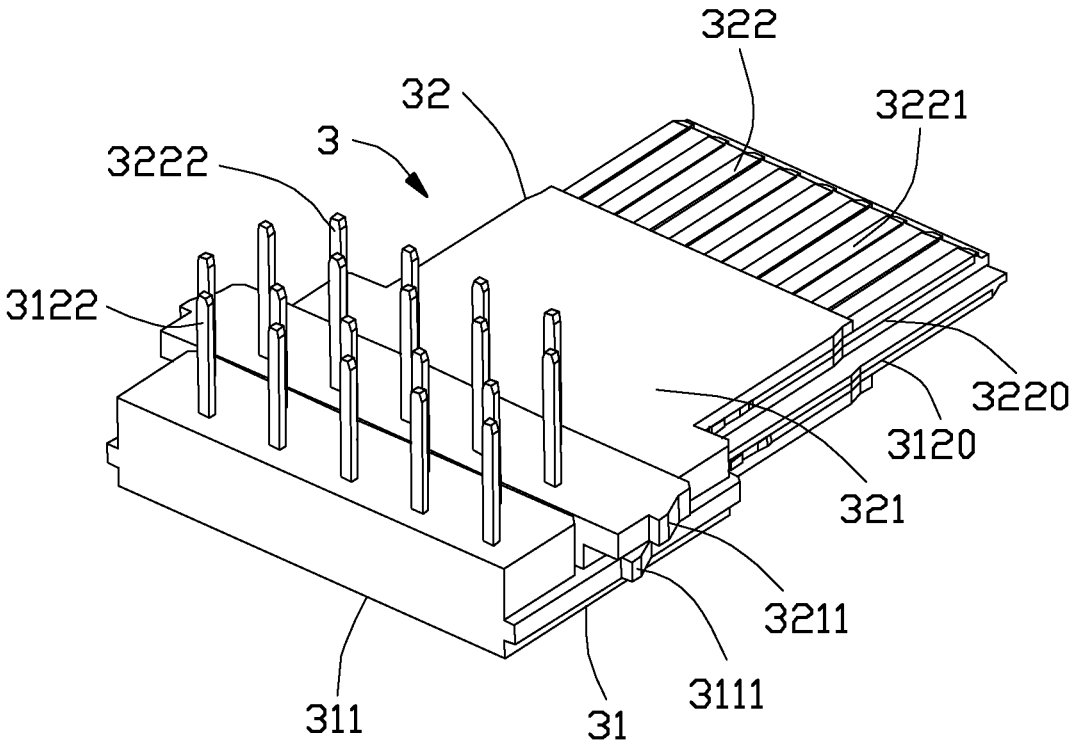
FIG. 6 is another perspective, assembled view similar to FIG. 5, taken from another aspect.
Figure 7:
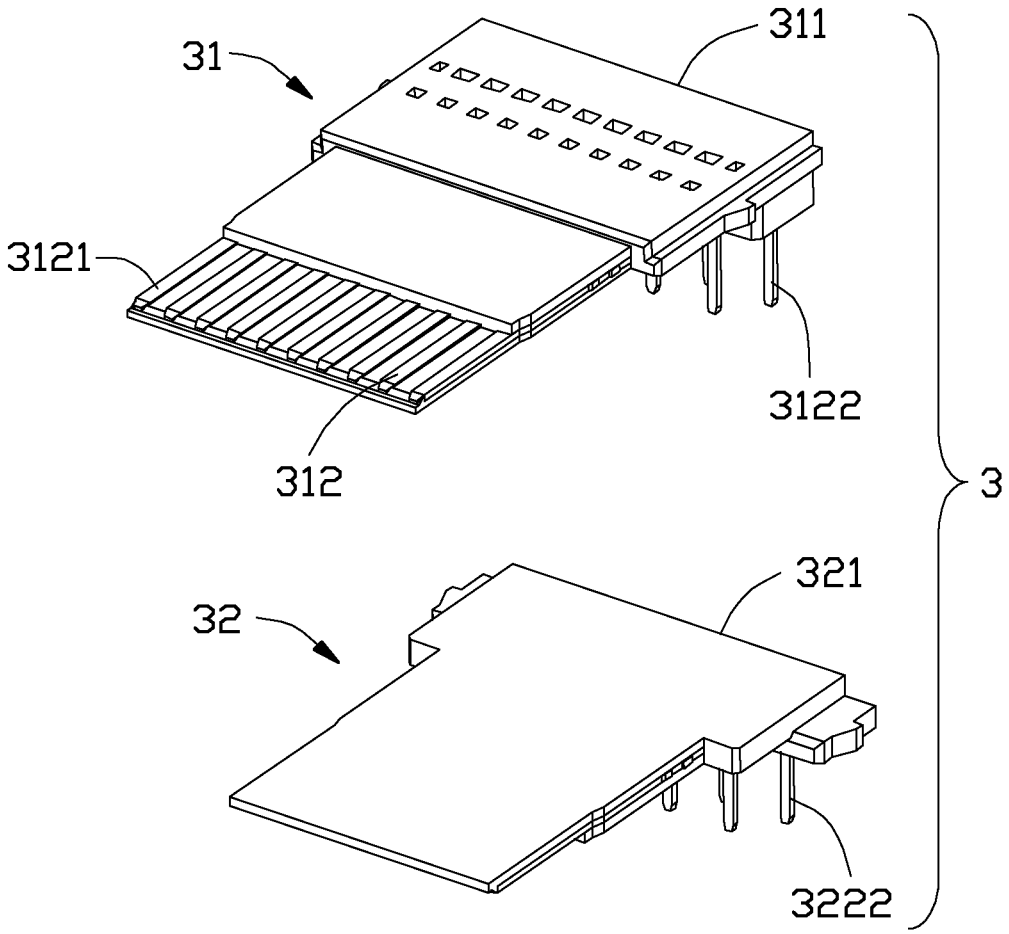
FIG. 7 is an exploded view of the contact module in FIG. 5.
Figure 8:
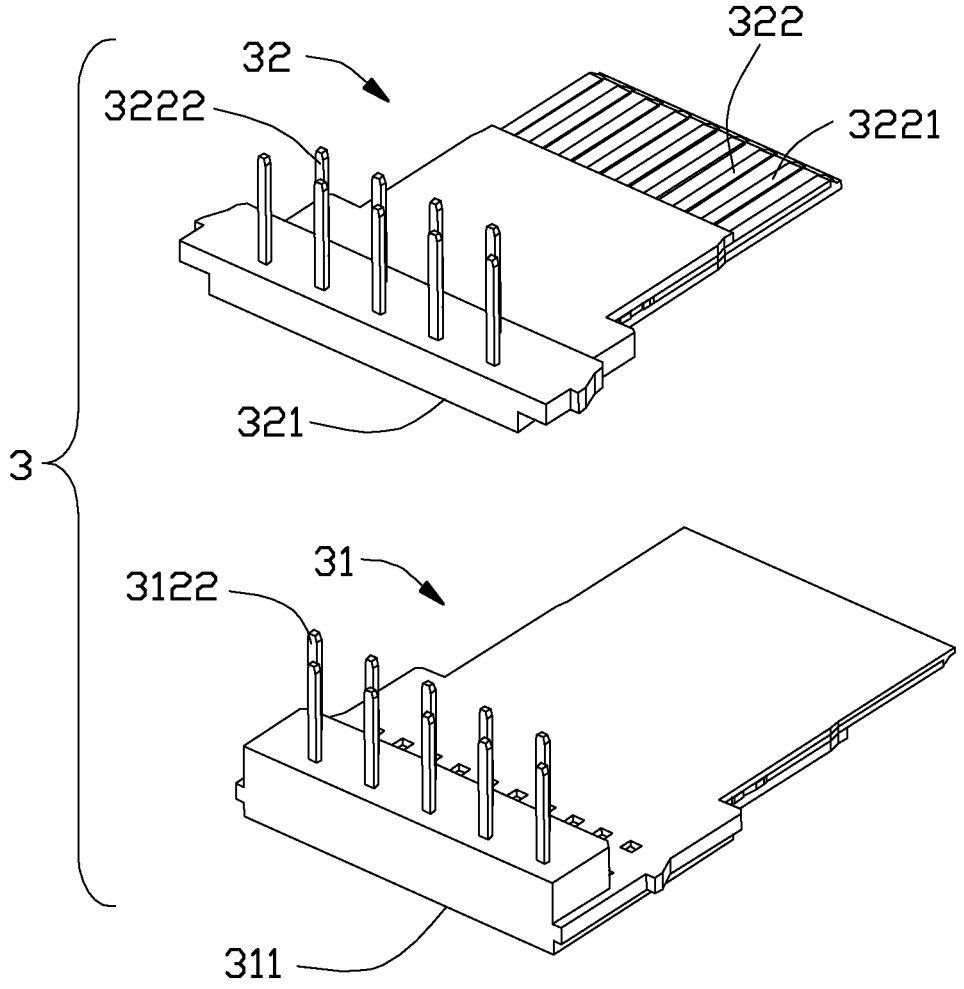
FIG. 8 is an exploded view of the contact module in FIG. 6.

Referring to FIGS. 3 and 4, the upper wall 11 and the lower wall 12 of the insulative housing 1 respectively defines a slot 111, a groove 125, and two second through holes 14. Each of the left wall 13 and the right wall (not labeled) defines a groove 131, a plurality of through holes 14, and a slot 16. The back-end of the lower wall 12 of the insulative housing 1 provides a stepped groove 121 interlinked with the receiving room 15. The both ends of the stepped groove 121 provide a pair of first leading/guiding grooves 124 and a pair of second leading/guiding grooves 122 below the first leading grooves 124. Although the first leading grooves 124 and the second leading grooves 122 stay away from each other, the inside of them respectively defines a pair of convex portions 1241 and a pair of protruding portions 1221. A pair of resisting portions 123 extends downwardly from the back-end of the second leading grooves 122.

Referring to FIGS. 5-8, the pair of the contact modules 3 includes a first contact module 31 and a second contact module 32 stacked with each other. The first contact module 31 includes a plurality of first conductive terminals 312 and a first insulative base 311 with a stepped shaped insert molded with the first conductive terminals 312. Each first conductive terminal 312 includes a first embedded portion 3121 having an upper surface (functioning as a mating section) of the first embedded portion 3121 exposed to an exterior in a vertical direction for mating, a first connecting portion 3120 completely embedded in the first insulative base 311 and a first bent portion 3122 bent downwardly from the first connecting portion 3120. The first contact module 31 further includes a pair of first guiding arms 3111 received in the first leading grooves 124 and comprising a pair of first tubers 3112. What's more, the first tubers 3112 resist the convex portions 1241 located in the first leading grooves 124.

The second contact module 32 comprises a plurality of second conductive terminals 322 and a second insulative base 321 with a stepped shaped insert molded with the second conductive terminals 322. Each second conductive terminal 322 includes a second embedded portion 3221 having a lower surface of the second embedded portion 3221 exposed, a second connecting portion 3220 completely embedded in the second insulative base 321 and a second bent portion 3222 bent downwardly from the second connecting portion 3220. The second contact module further includes a pair of second guiding arms 3211 received in the second leading grooves 122 and comprising a pair of second tubers 3212. Moreover, the second tubers 3212 resist the protruding portions 1221 located in the second leading grooves 122. The first insulative base 311 and the second insulative base 321 respectively supports the first embedded portion 3121 and the second embedded portion 3221 so as to make sure normal position of the first conductive terminal 312 and the second conductive terminal 322.

Figure 9:
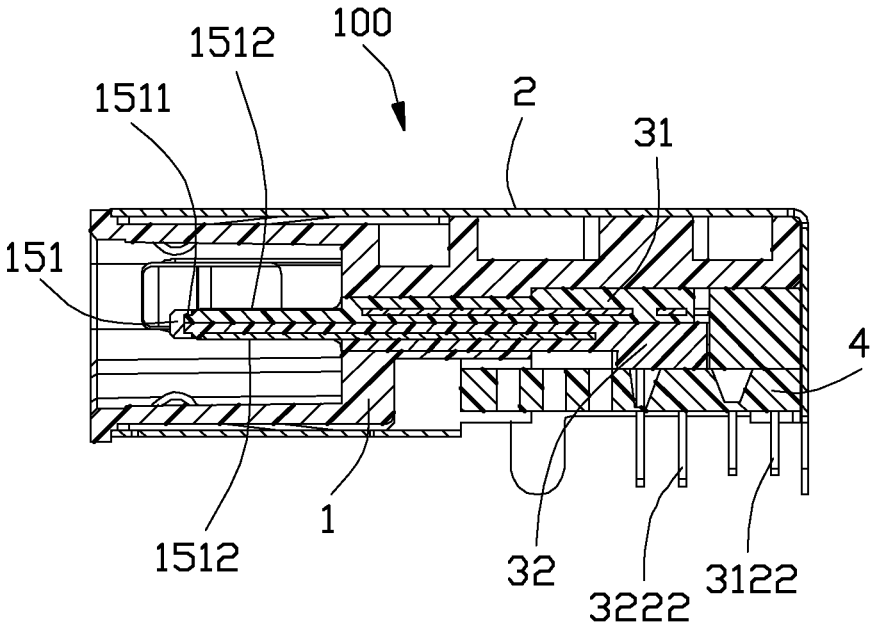
FIG. 9 is a cross-sectional view of the electrical connector taken along line 9-9 in FIG. 1.
Figure 10:
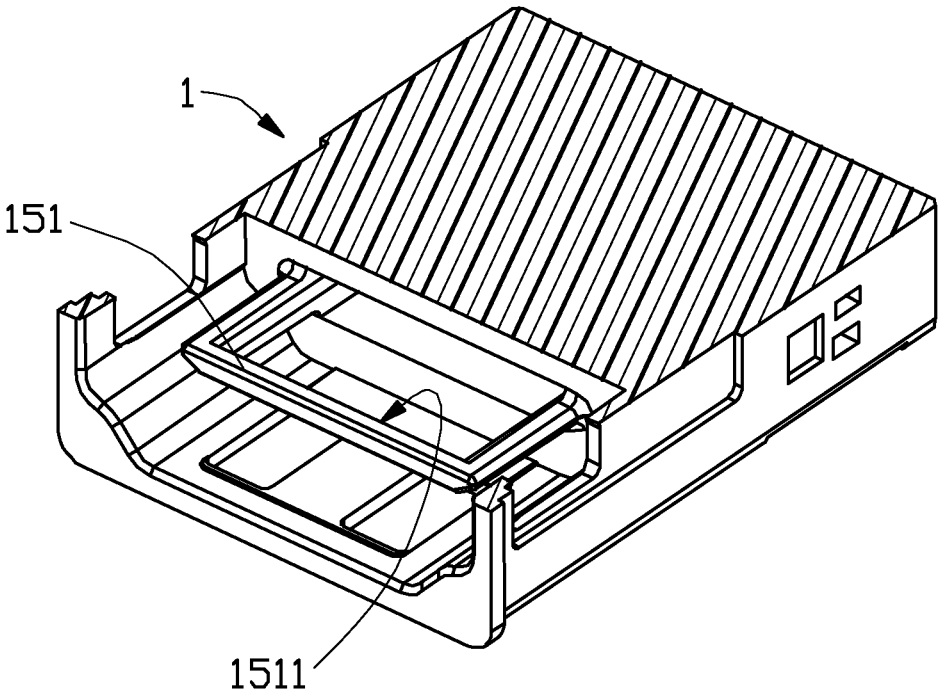
FIG. 10 is a perspective view of the housing of the electrical connector by removing the upper part thereof to show the tongue portion.

Referring to FIGS. 9-10, the tongue portion 151 of a frame like structure defines a recess 1511 engaging with a forehead of the contact modules 3 at a front end thereof and a first through hole or cavity 1512 receiving the contact modules 3 and having the first embedded portion 3121 exposed on a upper surface (functioning as a mating section) thereof and the second embedded portion 3221 exposed below a lower surface (functioning as a mating section) thereof from a front-to-end direction.

Referring to FIGS. 3-4, the fixing portion 4 defines a base body 41 with two bulging portions 44, an extension part 42 extending forwardly from the base body 41 and a plurality of mounting holes 43. The upper square is larger than the lower square of the mounting holes 43. The bulging portions 44 is received in the second leading grooves 122 of the insulative housing 1 which makes the fixing portion 4 assembled to the insulative housing 1.

Referring again to FIGS. 3-4, the shielding shell 2 is barrel shaped at the forehead thereof and the back-end is tray shaped. The shielding shell 2 defines a plurality of elastic pieces 21 at the forehead of the shielding shell 2 inserting into the insulative housing 1 by the through holes 14. The back-end of shielding shell 2 comprises an upper wall, a left and a right wall defining a pair of tubers 23, and a pair of buckling elastic portions 24 and a back wall comprising a pair of buckling portions 22. The back wall and the upper wall are in the same plane before the electrical connector is assembled. The back wall bends downwardly so as to make the buckling portions 22 resist the tubers 23 and the buckling elastic portions 24 stack with the slip slot 16 of the insulative housing 1 after installing.

Referring to FIGS. 1-8, firstly the insulative housing 1 is mounted to the shielding shell 2 through the front opening, while the elastic portions 21 of the shielding shell 2 insert into the second through holes 14 of the insulative housing 1 and the buckling elastic portions 24 resist the slip slot 16 of the insulative housing 1 when installing the electrical connector. Secondly when the first contact module 31 mated with the second contact module 32 in a way that the first contact module 31 is above the second contact module 32, the first bent portion 3122 and the second bent portion 3222 perform downwardly. Thirdly the pair of the contact modules 3 is received in the stepped groove 121 through the back-end of the insulative housing 1, the foreheads of the pair of the contact modules 3 are commonly engaged within the recess 1511 so as not to be separated from each other in the vertical direction, and leaves the first embedded portion 3121 and the second embedded portion 3221 exposed on the opposite two surfaces of the tongue portion 151 through the first through hole 1512 for mating in the vertical direction. The first guiding arms 3111 are received into the first leading grooves 124 while the second guiding arms 3211 are also received into the second leading grooves 122. The first tubers 3112 and the second tubers 3212 respectively resist the convex portions 1241 of the first leading grooves 124 and the protruding portions 1221 of the second leading grooves 122 so as to enhance buckling force between the pair of the contact modules 3 and the insulative housing 1. Fourthly the fixing portion 4 is located in the stepped groove 121 of the insulative housing 1. The first bent portion 3122 and the second bent portion 3222 go through the mounting holes 43 of the fixing portion 4. The first connecting portion 3120 and the second connecting portion 3220 are completely embedded in the first insulative 311 and the second insulative base 321. Also the bulging portion 44 of the fixing portion 4 inserts into the resisting portions 123 and then buckles with the second leading grooves 122 of the insulative housing 1 when the resisting portions 123 resist against by the base body 41 of the fixing portion 4. Finally the back wall of the shielding shell 2 bends downwardly till the buckling portions 22 engage with the tubers 23.

By the steps as described above, the electrical connector 100 can be assembled completely. The first conductive terminal 312 and the second conductive terminal 322 are insert molded with the first insulative base 311 and the second insulative base 321. Moreover, the first embedded portion 3121 stretches out from the first insulative base 311, and the second embedded portion 3221 stretches out from the second insulative base 321 while the first and the second connecting portion 3120, 3220 are completely embedded in the first and second insulative base 311,312. This ensures the normal position of the first conductive terminal 312 and the second conductive terminal 322. It is also convenient for the stacking of the contact module 3 as well as the electrical connector 100.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing defining a receiving room and a tongue portion in the receiving room;

a first contact module being received in the insulative housing and comprising a first insulative base and a plurality of first conductive terminals insert molded in the first insulative base, each first conductive terminal including a first embedded portion having an exposed upper surface, a first connecting portion completely embedded in the first insulative base, and a first bent portion bent downwardly from the first connecting portion;

a second contact module integrated under the first contact module, the second contact module being received in the insulative housing and comprising a second insulative base and a plurality of second conductive terminals insert molded in the second insulative base, each second conductive terminal including a second embedded portion having an exposed lower surface, a second connecting portion completely embedded in the second insulative base and a second bent portion bent downwardly from the second connecting portion;

wherein the tongue portion defines a recess at a front end thereof and a first through hole, the recess engaging with a forehead of the first and second contact modules, the first through hole receiving the first and second contact modules while exposing the exposed upper surface of the first embedded portion and the exposed lower surface of the second embedded portion.

2. The electrical connector as claimed in claim 1, further including a shielding shell enclosing the insulative housing and having a plurality of elastic pieces.

3. The electrical connector as claimed in claim 1, wherein:

the insulative housing includes a stepped groove having a pair of first leading grooves and a pair of second leading grooves, each first leading groove having a convex portion, each second leading groove having a protruding portion;

the first contact module includes a pair of first guiding arms, each first guiding arm having a first tuber mated with the convex portion of the each first leading groove; and the second contact module includes a pair of second guiding arms, each second guiding arm having a second tuber mated with the protruding portion of each second leading groove.

4. The electrical connector as claimed in claim 3, further including a fixing portion mounted below the second contact module, the fixing portion defining a plurality of holes receiving the bent portions of the first and second contact modules.

5. The electrical connector as claimed in claim 4, wherein the fixing portion comprises a base body and a stretching portion, two sides of the base body including a pair of bulging portions received in the second leading grooves.

6. The electrical connector as claimed in claim 1, wherein the insulative housing includes a plurality of second through holes engaging with the elastic pieces.

7. An electrical connector comprising:

an insulative housing forming a receiving room communicating forwardly with an exterior along a front-to-back direction with a tongue portion unitarily formed therein;

a through cavity formed within the tongue portion so as to result in a frame configuration of said tongue portion;

a first terminal module including a plurality of first terminals embedded within and retained by a first insulative base, each of said first terminals including a first front mating section supported by the first insulative base and exposed to said exterior in a vertical direction perpendicular to said front-to-back direction;

a second terminal module including a plurality of second terminals embedded within and retained by a second insulative base, each of said second terminals including a second front mating section supported by the second insulative base and exposed to the exterior in another vertical direction opposite to said vertical direction; wherein the first terminal module and the second terminal module are back to back stacked with each other in said vertical direction and forwardly assembled into the housing along said front-to-back direction, and front portions of said first insulative base and said second insulative base are commonly received within the through cavity and surrounded by said frame configuration and exposed to said exterior along said vertical directions.

8. The electrical connector as claimed in claim 7, wherein the frame configuration defines an inner recess to receive foreheads of both said first and second terminal modules therein for securing together.

9. The electrical connector as claimed in claim 7, wherein the housing forms a pair of guiding grooves behind the tongue portion to retain one of said first terminal module sand said second terminal module.

10. The electrical connector as claimed in claim 7, wherein each of said first terminal module and said second terminal module forms a stepped structure around a root of said tongue portion.

11. The electrical connector as claimed in claim 7, wherein one of said first terminal module and said second terminal module include a step compliantly abutting against another stepped structure on the housing for prohibiting further forward movement of said one of the first terminal module and said second terminal module.

12. The electrical connector as claimed in claim 7, wherein each of the first terminals further includes a first rear tail section extending along the vertical direction and embedded within the first insulative base of the first terminal module, each of the second terminals further includes a second rear tail section extending along the vertical direction and embedded within the second insulative base of the second terminal module, and the second rear tail sections are located in front of the first rear tail sections in the front-to-back direction and commonly regulated by an insulative spacer.

13. The electrical connector as claimed in claim 7, further including a metallic shell enclosing the housing, wherein the shell includes a plurality of elastic portions extending into the receiving room via corresponding through holes in corresponding peripheral walls of the housing.

14. An electrical connector comprising:

an insulative housing including unitarily a plurality of peripheral walls commonly defining a receiving room, and a tongue portion forwardly extending into the receiving room in a front-to-back direction, and defining a through cavity in a vertical direction perpendicular to front-to-back direction, said through cavity communicating with a rear portion of the housing, a recess formed in the tongue portion; and a terminal module including a plurality of contacts embedded within and retained by an insulative base, a mating section of each of said contacts supported by the insulative base in the vertical direction, said terminal module forwardly assembled into the housing in the front-to-back direction; wherein said insulative base is received in the through cavity and a forehead of the insulative base is engaged within the recess for retention.

15. The electrical connector as claimed in claim 14, further including a metallic shell enclosing the housing, wherein said shell includes a plurality of elastic portions extending into the receiving room through corresponding through holes in the peripheral walls.

16. The electrical connector as claimed in claim 14, wherein the insulative base forms a stepped structure around a root of said tongue portion.

17. The electrical connector as claimed in claim 14, wherein the insulative base forms a stepped structure compliantly abutting against the housing for prohibiting further forward movement.

* * * * *